US006066119A

United States Patent [19]

Ball

[11] Patent Number: 6,066,119

[45] Date of Patent: May 23, 2000

[54] WASTE WATER STRAINER AND VALVE

[75] Inventor: William T. Ball, Leawood, Kans.

[73] Assignee: WCM Industries, Inc., Colorado Springs, Colo.

[21] Appl. No.: 09/209,395

[22] Filed: Dec. 10, 1998

[51] Int. Cl.[7] ..... E03C 1/22

[52] U.S. Cl. ..... 604/287; 4/286

[58] Field of Search ..... 4/286, 287, 288, 4/290, 291, 292, 295

[56] References Cited

U.S. PATENT DOCUMENTS

| | | | |
|---|---|---|---|
| 3,314,085 | 4/1967 | Minelli | 4/287 |
| 4,457,030 | 7/1984 | Burry | 4/286 |
| 5,428,847 | 7/1995 | Atkins et al. | 4/295 |

*Primary Examiner*—Robert M. Fetsuga
*Attorney, Agent, or Firm*—Zarley McKee, Thomte, Voorhees & Sease

[57] ABSTRACT

A waste water strainer has a horizontal flange having a center opening. A hollow barrel is secured to and extends downwardly from the flange and has a center opening concentrically located with respect to the center opening in the flange. A hollow strainer extension is threadably secured to a lower end of the barrel. A bushing with an internal concave surface is mounted within the upper end of the strainer extension. A circular disk valve having an annular outer surface symmetrical with the concave surface of the bushing is pivotally mounted on the concave surface of the bushing. The flange and the barrel have a chrome-like finished surface, and the strainer extension has a different finish surface.

11 Claims, 3 Drawing Sheets

WASTE WATER STRAINER AND VALVE

BACKGROUND OF THE INVENTION

A strainer in the plumbing field is the threaded fitting in the bottom of a sink, bathtub, or the like through which waste water flows from the receptacle. Strainers usually have valves or the like which control the gravity flow of water therethrough. All of these valve assemblies are threadably mounted within a threaded aperture located in the strainer.

Typically, existing strainers are of one-piece construction and have a flange which engages the bottom of the tub and a downwardly extending threaded sleeve which threads onto a fitting adjacent a vertically disposed aperture in the bottom of the water receptacle. The entire strainer is often made of chrome or the like which is a relatively expensive material. It is also difficult to machine such a one-piece device to provide threads in places for its attachment to other components in the drain assembly.

It is therefore a principal object of this invention to provide a strainer which is very economical from both a material point of view and from a fabrication point of view.

More specifically, it is a further object of this invention to provide a strainer comprised of two pieces wherein the strainer assembly is comprised of two components, namely, a flange to engage the surface around the discharge aperture in the bathtub, and a strainer extension which is threadably secured thereto, and wherein the flange is comprised of a chrome plated material and the strainer extension is comprised of brass or a more economical material.

A still further object of the invention is to provide a strainer which has a valve therein which is easily installed, operated, and which is durable in use.

These and other objects will be apparent to those skilled in the art.

SUMMARY OF THE INVENTION

A waste water strainer has a horizontal flange having a center opening. A hollow barrel is secured to and extends downwardly from the flange and has a center opening concentrically located with respect to the center opening in the flange. A hollow strainer extension is threadably secured to a lower end of the barrel.

A bushing with an internal concave surface is mounted within the upper end of the strainer extension. A circular disk valve having an annular outer surface symmetrical with the concave surface of the bushing is pivotally mounted on the concave surface of the bushing.

The flange and the barrel have a chrome-like finished surface, and the strainer extension has a different finish surface.

DESCRIPTION OF THE PREFERRED EMBODIMENT

Figure 1:
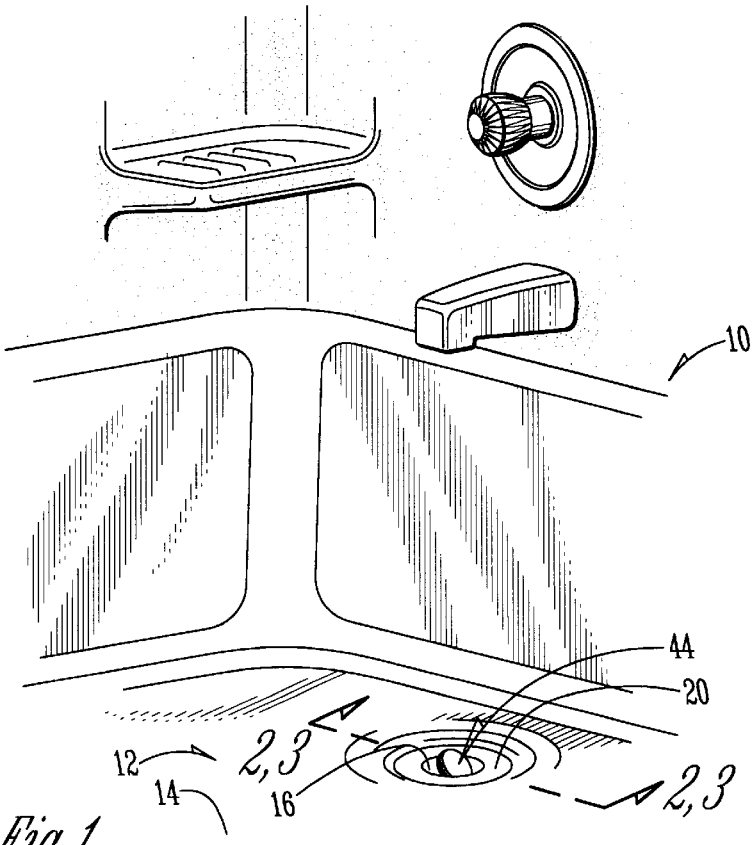
FIG. 1 is a partial perspective view of a conventional bathtub with a conventional waste water strainer located in the bottom thereof.

The numeral 10 designates a conventional fluid compartment or receptacle such as a tub or sink. Compartment 10 has a bottom 12 with an interior bottom surface 14. A waste water aperture 16 is located in bottom 12.

A waste water strainer 18 (FIGS. 1–4) has a peripheral flat flange 20 with a center opening 22. A downwardly extending hollow barrel is integrally formed with flange 22. The diameter of opening 22 in flange 20 is smaller than the diameter of the barrel 24. Barrel 24 has internal threads 26 and external threads 28 (FIG. 4).

Figure 2:
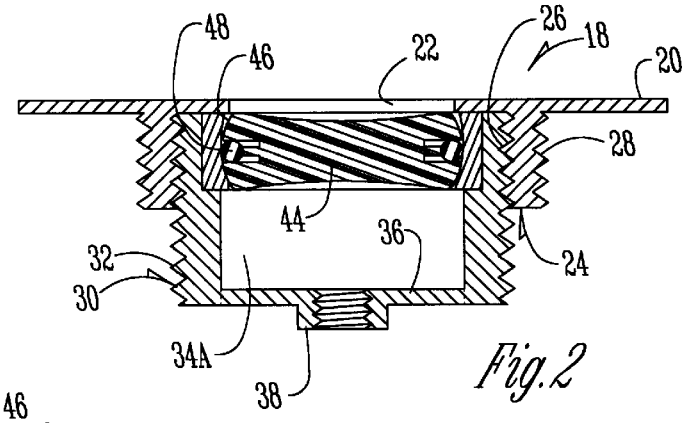
FIG. 2 is an enlarged scale sectional view taken on line 2—2 through the waste water strainer.
Figure 3:
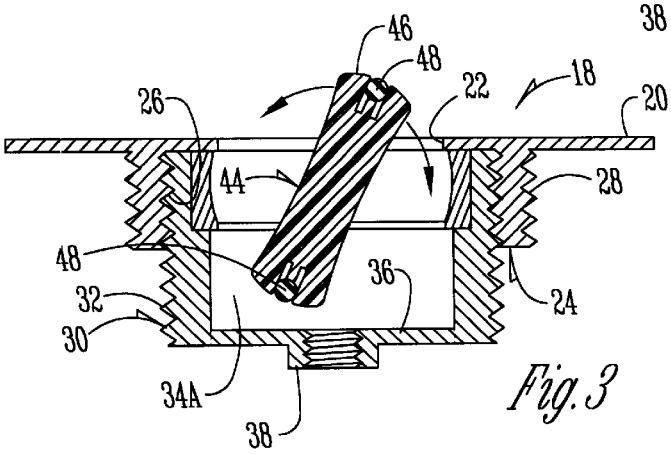
FIG. 3 is a view similar to that of FIG. 1 but shows the waste water strainer in FIG. 1 with the valve thereof in an open condition.
Figure 4:
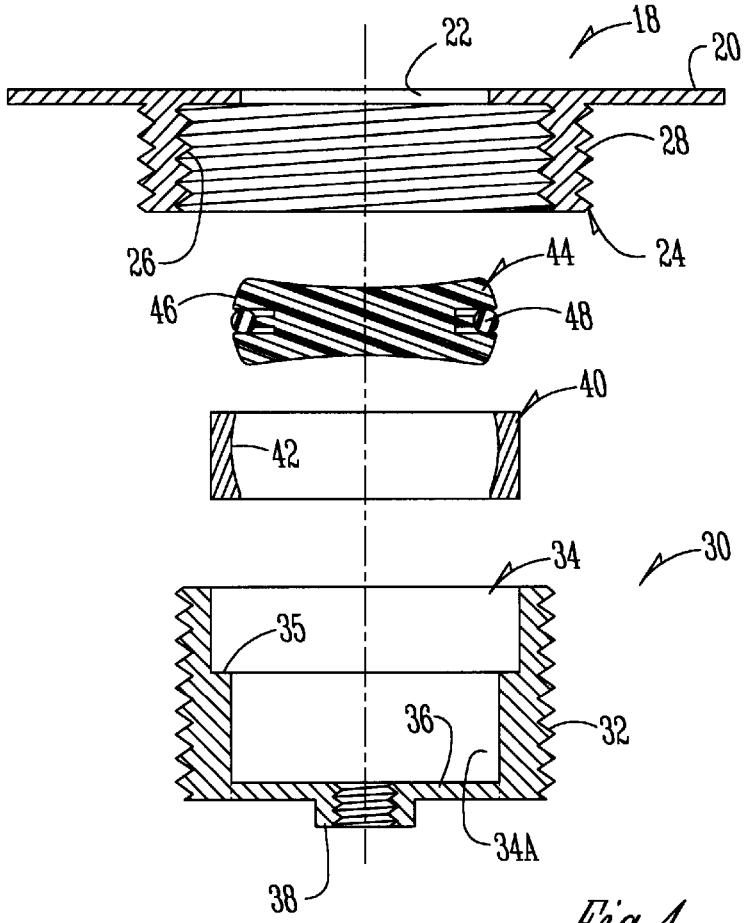
FIG. 4 is an exploded view of the non-assembled components of the device of FIG. 2.

A strainer extension 30 (FIGS. 1–4) has external threads 32 which match the internal threads 26 of barrel 24 (FIGS. 2 and 3). The strainer extension 30 has a center opening 34 at its top which communicates with a center opening 34A in its lower portion of a slightly smaller diameter. The portions 34 and 34A are separated by a shoulder 35 which will be discussed hereafter.

Radial-spaced arms 36 and the bushing 38 are present to permit an alternate form of a closure valve to be used such as that disclosed in U.S. Pat. No. 5,758,368. The plurality of spaced arms 36 extend radially outwardly from internally threaded bushing 38 with the outer end of the arms 36 being rigidly connected to the internal bottom diameter of the center opening 34A of the strainer extension 30. (FIGS. 2–4).

A cylindrical bushing 40 rests in center opening 34 upon shoulder 35. Bushing 40 has an internal concave shaped surface 42 which rotatably receives a valve disk 44. Disk 44 has a concave outer periphery surface 46. A resilient O-ring 48 is located within an annular notch 50 in the outer surface 46 of disk 44 to yieldingly but frictionally engage the concave inner surface 46 of the bushing 40.

Figure 5:
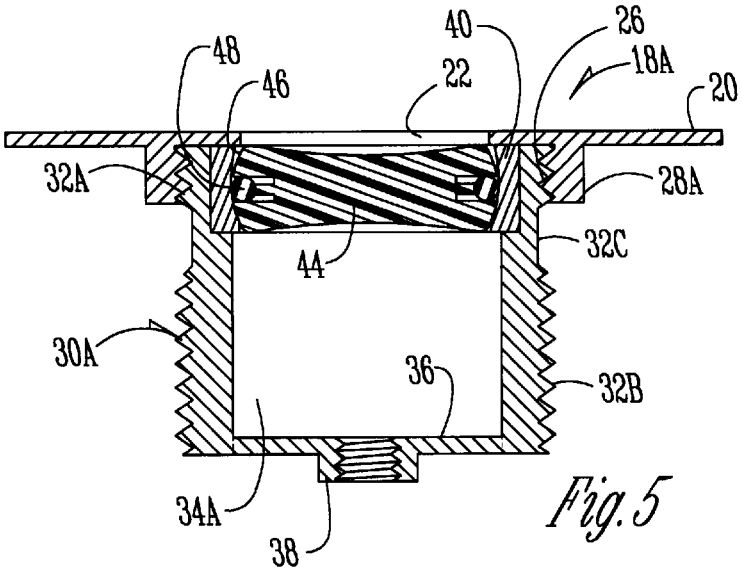
FIG. 5 is a sectional view similar to that of FIG. 2 but shows an alternate form of the invention.
Figure 6:
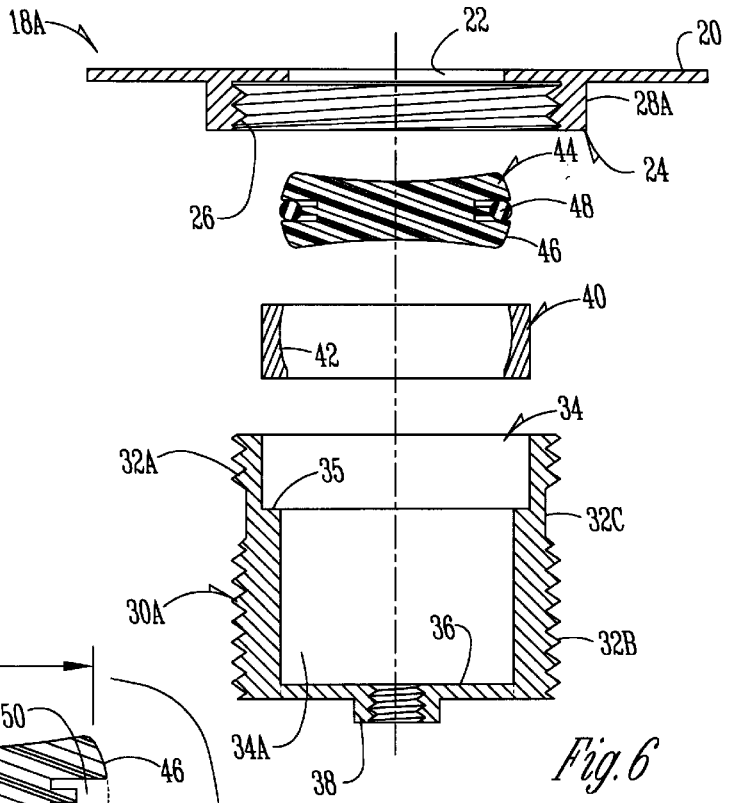
FIG. 6 is an exploded view similar to FIG. 4 but showing the alternate form of the invention of FIG. 5.

An alternate form of the invention is shown in FIGS. 5 and 6. The structure of the alternate form of the invention is identical to the device of FIGS. 2–4 with two exceptions. The waste water strainer 18A of FIGS. 5 and 6 does not have the external threads 28 of the strainer 18, but rather, has an unthreaded cylindrical surface 28A (FIG. 6). Further, the strainer extension 30A of FIGS. 5 and 6 has a external threads 32A and 34A separated by an intermediate cylindrical non-threaded band 32C.

Figure 7:
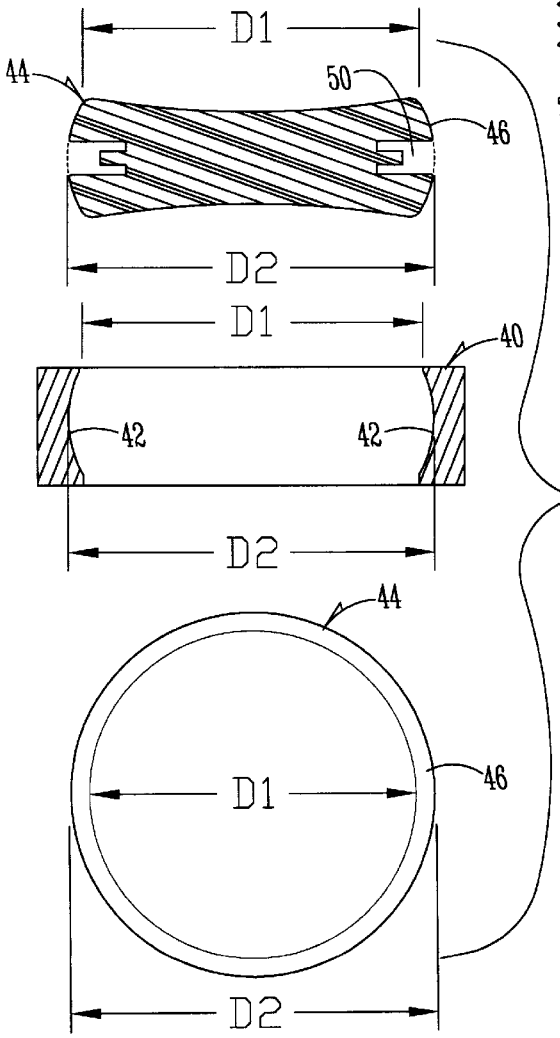
FIG. 7 is a composite view of the valve disk and a bushing showing the relative diameters of common surfaces.

With reference to FIG. 7, the disk 44 and the concave inner surface 42 of bushing 40 all have a minor diameter D1 and a larger major diameter D2 with the major and minor diameters of the two components being substantially equal. Further, it is seen that the minor diameter D1 of disk 44 is substantially equal to the diameter of the opening 22 in the flange of both the waste water strainers 18 and 18A. The similarities in the foregoing dimensions are to permit the disk 44 to be pivoted from the closed position of FIGS. 2 an 5 to an open position as shown in FIGS. 1 and 3. The O-ring 48 frictionally maintains the disk in any given position within the concave surface 42 of the bushing 40. However, manual rotational pressure on the disk 44 will cause it to rotate to any position between being completely open or completely closed.

A very important part of this invention is the fact that the structure of the waste water strainers 18 and 18A, including the flanges 20 and the downwardly extending barrels 24, are of chrome or are chrome plated to provide a chrome-like finished surface to provide a stable, durable, and attractive appearance. While having such a finish, the chrome plating or equivalent is an expensive process. However, the strainer extensions 30 are comprised of brass to provide a brass-like finished surface or the like which is a much more economical material to finish and fabricate. Thus, the devices of this invention are much more economical to both finish and to machine than the typical one-piece waste water assemblies of the prior art. Further, the disk 44 provides a very economical way to open and close the waste water assemblies of this invention. It is therefore seen that this invention will achieve at least all of its stated objectives.

What is claimed is:

1. A waste water strainer, comprising, a horizontal flange having a center opening, a hollow barrel secured to and extending downwardly from the flange and having a center opening concentrically located with respect to the center opening in the flange, and a hollow strainer extension threadably secured to and extending downwardly from a lower end of the barrel, a bushing with an internal concave surface mounted within an upper end of the strainer extension, and a circular disk valve having an annular outer surface symmetrical to the concave surface of the bushing pivotally mounted on the concave surface of the bushing.

2. The strainer of claim 1 wherein the flange and barrel are of one integral piece.

3. The strainer of claim 1 wherein the flange and barrel are comprised of one material, and the strainer extension is comprised of a different material.

4. The strainer of claim 3 wherein said flange and barrel have a chrome-like finished surface and the strainer extension has a different finished surface.

5. The strainer of claim 1 wherein said barrel is internally threaded and mates with external threads on an upper end of the strainer extension.

6. The strainer of claim 1 wherein the disk valve and concave surface each have major and minor diameters which are substantially equal.

7. The strainer of claim 6 wherein the major diameter of the disk valve is substantially the same as the diameter of the center opening in the flange.

8. The strainer of claim 1 wherein the center opening in the flange is smaller than the center opening in the barrel.

9. The strainer of claim 1 wherein an O-ring is in the center annular surface of the disk valve to frictionally engage the concave surface of the bushing.

10. The strainer of claim 1 wherein said flange and barrel have a chrome-like finished surface and the strainer extension has a different finished surface.

11. The strainer of claim 4 wherein the flange and barrel are of chrome, and the strainer extension is of brass.

* * * * *